US006445403B1

(12) United States Patent
Masubuchi et al.

(10) Patent No.: US 6,445,403 B1
(45) Date of Patent: Sep. 3, 2002

(54) OPTICAL PRINTER

(75) Inventors: Sadao Masubuchi; Shigeru Futakami; Masaaki Matsunaga; Masafumi Yokoyama; Akira Shiota, all of Saitama; Shinichi Nonaka, Tokyo, all of (JP)

(73) Assignee: Citizen Watch Co., Ltd., Tokyo (JP)

( * ) Notice: Subject to any disclaimer, the term of this patent is extended or adjusted under 35 U.S.C. 154(b) by 0 days.

(21) Appl. No.: 09/402,030

(22) PCT Filed: Jan. 29, 1999

(86) PCT No.: PCT/JP99/00395

§ 371 (c)(1),
(2), (4) Date: Sep. 28, 1999

(87) PCT Pub. No.: WO99/38698

PCT Pub. Date: Aug. 5, 1999

(30) Foreign Application Priority Data

Jan. 30, 1998 (JP) ..... 10-18917

(51) Int. Cl.[7] ..... B41J 2/47; B41J 2/445
(52) U.S. Cl. ..... 347/232; 347/225; 355/32
(58) Field of Search ..... 355/32–35, 38–44; 347/232, 238–240, 225, 233, 234, 235; 358/474, 478

(56) References Cited

U.S. PATENT DOCUMENTS

| | | | | |
|---|---|---|---|---|
| 5,032,911 | A | 7/1991 | Takimoto | |
| 5,621,453 | A | 4/1997 | Fujita et al. | |
| 6,262,757 | B1 * | 7/2001 | Masubuchi et al. | 347/225 |
| 6,275,247 | B1 * | 8/2001 | Masubuchi et al. | 347/232 |

FOREIGN PATENT DOCUMENTS

| | | |
|---|---|---|
| EP | 0 393598 | 10/1990 |
| JP | 63-123021 | 5/1988 |
| JP | 2-80271 | 3/1990 |
| JP | 2-169270 | 6/1990 |

* cited by examiner

*Primary Examiner*—Alan A. Mathews
(74) *Attorney, Agent, or Firm*—Smith, Gambrell & Russell, LLP

(57) ABSTRACT

In an optical printer apparatus designed so that an optical head (100) having an LED light source (110) therein is moved relatively to a sensitized sheet (500) and an image is formed by emitting a plurality of color light beams in regular order from the LED so that the light beams are focused at given spaces on the sensitized sheet, an image pitch P for the color light beams is substantially equal to an integer multiple of the maximum exposure distance D.

22 Claims, 18 Drawing Sheets

OPTICAL PRINTER

TECHNICAL FIELD

The present invention relates to an optical printer apparatus capable of relatively moving on a sensitized sheet to expose it with given timing, thereby forming an image, and more specifically, to a technique for controlling the exposure timing of the optical printer apparatus.

BACKGROUND ART

Disclosed in Japanese Patent Application Laid-open No. 2-169270 is an optical printer apparatus in which an optical head is relatively moved on a sensitized sheet to form an image on the sensitized sheet. This optical printer apparatus will now be described with reference to FIG. 16.

A sensitized sheet 60 is driven at constant speed in the direction of arrow Z with respect to the optical head 10 by means of feed rollers 70. The optical head 10 comprises a white light source 20 for radially emitting white light, a cylindrical lens 30 for linearly converging the white light on the sensitized sheet 60, a three-color separation liquid crystal shutter 40, and a liquid crystal shutter 50.

The three-color separation liquid crystal shutter 40 is composed of three shutters 40*r*, 40*g* and 40*b* that linearly extend in the width direction (spreading direction) of the white light from the cylindrical lens 30. These three shutters 40*r*, 40*g* and 40*b* are driven independently of one another, and are provided individually with color filters that transmit red (R), green (G), and blue (B) light beams, respectively.

The liquid crystal shutter 50 includes a plurality of pixels that are arranged in the same direction as the lengthwise direction of the shutters 40*r*, 40*g* and 40*b*.

The following is a description of a method for forming an image on the sensitized sheet 60 by means of the apparatus shown in FIG. 16.

The optical printer apparatus receives gradated color image data, controls the shutters 40*r*, 40*g* and 40*b* in accordance with the image data, and exposes the surface of the sensitized sheet 60, thereby forming the image thereon. After the shutter 40*r* opened, the shutter 40*g* opens for a predetermined time, and after the shutter 40*g* opened, the shutter 40*b* opens for a predetermined time, to transmit the white light. This predetermined time is just equal to a period of time during which the sensitized sheet 60 moves for a distance X in FIG. 16.

Thus, the sensitized sheet 60 is exposed to the red light beam (R), which is first transmitted through the shutter 40*r*, for the distance X in its moving direction (direction Z). Then, the shutter 40*r* is closed, while the shutter 40*g* opens. Since the sensitized sheet 60 is moved for the distance X by this time, that portion of the sensitized sheet 60 which has already been exposed to the light beam R is exposed again to the green light beam (G) that is transmitted through the shutter 40*g*. When the sensitized sheet 60 further moves for the distance X, thereafter, the portion already exposed to the light beams R and G is exposed in like manner to the blue light beam (B) that is transmitted through the shutter 40*b*. By repeating these processes of operation in the feeding direction of the sensitized sheet 60, an image of full-color display can be obtained.

In a direction perpendicular to the feeding direction of the sensitized sheet 60, an image is formed by means of the liquid crystal shutter 50.

Referring now to FIG. 17, there will be described exposure timing for the formation of an image by means of the conventional optical printer apparatus shown in FIG. 16.

In FIG. 17, it is supposed, for ease of illustration, that the sensitized sheet 60 is stationary and the optical head 10 moves in the direction of arrow Z. In order to indicate the color, R, G or B, of the light beam to which the sensitized sheet 60 is exposed, moreover, the sensitized sheet 60 is divided into three layers for convenience. Exposure of the sensitized sheet 60 to the light beam R is represented by the hatching on the first layer from the top, among the aforesaid three layers. Likewise, exposure to the light beam G and exposure to the light beam B are represented by hatching the second and third layers, respectively. It is, to be understood that FIG. 17 never illustrates the fact that the actual sensitized sheet 60 is composed of those three layers.

Sections ① to ⑥ individually represent pixels in the moving direction (direction Z in FIG. 17) of the optical head. The width of each pixel is represented by X in FIG. 17.

Item (a) of FIG. 17 shows a state in which the light beam R starts to be radiated so that the optical head 10 exposes the section ③ on the sensitized sheet 60 thereto. As this is done, the light beams G and B are not radiated. Then, the optical head 10 radiates the light beam R as it moves at uniform speed for the distance X (equal to the pixel width) in the direction of arrow Z. The exposure of the section ③ to the light beam R terminates when the position of (b) of FIG. 17 is reached.

The moment the optical head 10 comes to the position of (b) of FIG. 17 to finish the radiation of the light beam R, the optical head 10 starts to radiate the light beam G for the section ③, as shown in (c) of FIG. 17. The section ③ has already been exposed to the light beam R, as described above. Then, the optical head 10 radiates the light beam G as it moves at uniform speed for the distance X in the direction of arrow Z. The exposure of the section ③ to the light beam G terminates when the optical head 10 comes to the position of (d) of FIG. 17.

The moment the optical head 10 comes to the position of (d) of FIG. 17 to finish the radiation of the light beam G, the optical head 10 starts to radiate the light beam B for the section ③, as shown in (e) of FIG. 17. The section ③ has already been exposed to the light beams R and G, as described above. Then, the optical head 10 radiates the light beam B as it moves at uniform speed for the distance X in the direction of arrow Z. The exposure of the section ③ to the light beam B terminates when the optical head 10 comes to the position of (f) of FIG. 17.

As described above, the section ③ of the sensitized sheet 60 is exposed to the light beams R, G and B in a series of processes of operation shown in (a) to (f) of FIG. 17. This series of operation processes will hereinafter be referred to as an exposure cycle. In a second exposure cycle subsequent to this cycle, the section ⑥ is exposed, as shown in (g) of FIG. 17.

In the conventional optical printer, as described above, a full-color image can be formed on the sensitized sheet 60 by continuously repeating the aforesaid exposure cycles.

According to the conventional optical printer apparatus arranged in this manner, however, the image pitch or spacing between images is equal to a maximum exposure distance (mentioned later), as mentioned before, so that the position of the section ③, which is situated at a distance 2X from the exposed section ③, is exposed between the first and second exposure cycles, as shown in (g) of FIG. 6.

Thus, according to the conventional optical printer apparatus, the image involves an unexposed portion (i.e., sections ④ and ⑤ that is twice as long as the exposure distance X between the exposure cycles, resulting in lowered resolution and image quality.

DISCLOSURE OF THE INVENTION

The object of the present invention is to provide an optical printer apparatus, capable of printing high-resolution, high-quality color images free from unexposed portions.

In order to achieve the above object, an optical printer apparatus according to the present invention comprises an optical head, capable of radiating a plurality of color light beams while moving relatively to a sensitized material, and a drive unit for driving the optical head and/or the sensitized material in order to cause the optical head and the sensitized material to move relatively to each other at constant speed, and is designed so that individual images formed on the sensitized material when the color light beams are radiated simultaneously are arranged at given pitches in the direction of the relative movement when the optical head is stationary with respect to the sensitized material, and that an image is formed on the sensitized material as the light beams are applied in regular order accompanying the relative movement of the optical head. Let P be the image pitch of the color light beams on the sensitized material and D be the maximum exposure distance corresponding to the maximum emission time of the color light beams for each pixel, the maximum exposure distance D is set smaller than the image pitch P.

According to the present invention, the whole area of the sensitized material can be exposed even in the case where the color light beams on the sensitized material cannot be focused in close vicinity to one another in the moving direction of the optical head, so that the resolution of the image can be improved. Since the gradation of a region between each two adjacent pixels is the average of the respective gradations of the pixels, a fine image with good color mixture can be obtained.

BEST MODE FOR CARRYING OUT THE INVENTION

Figure 1A:
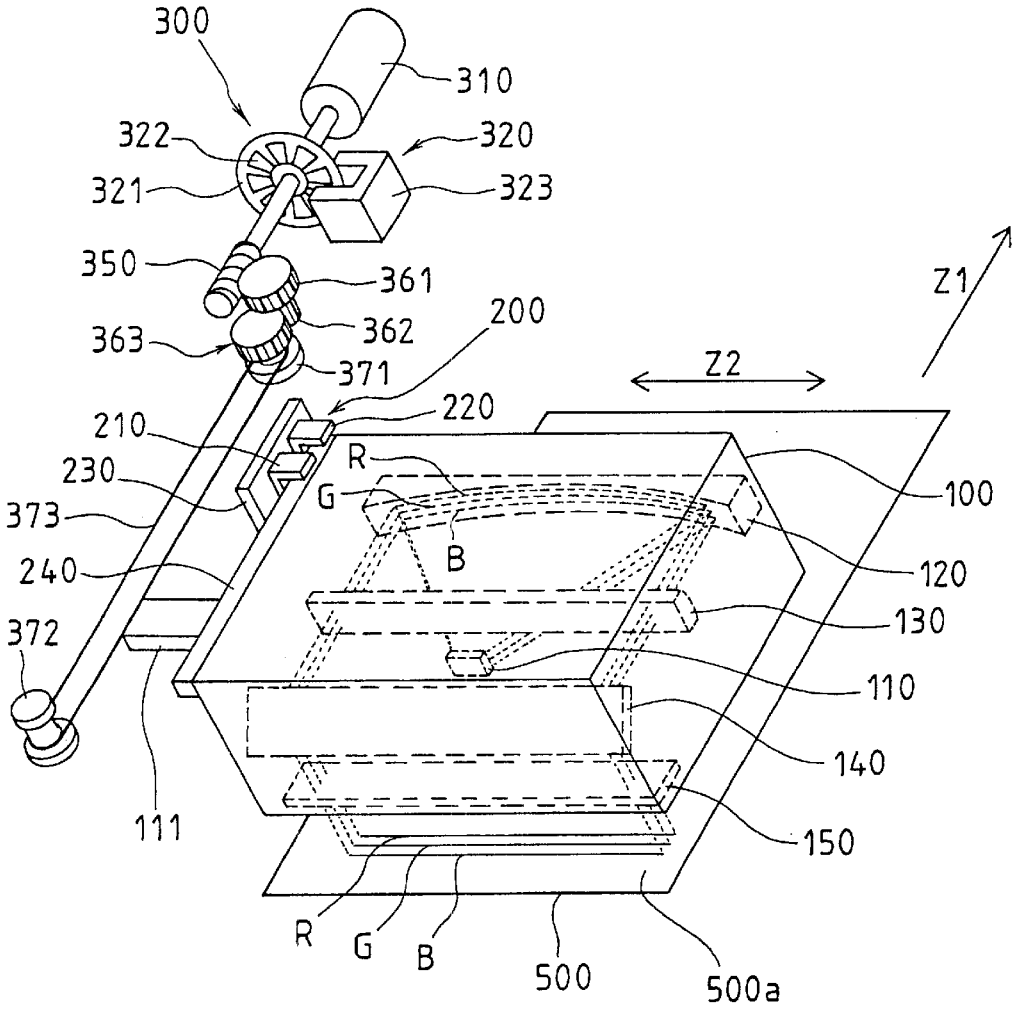
FIG. 1A is a perspective view showing an outline of an optical printer apparatus according to the present invention.

First, the principal part of an optical printer apparatus will be described with reference to FIGS. 1A and 1B.

An optical head 100 contains therein an optical system that is composed of a paraboloidal mirror 120, a cylindrical lens 130, and a reflector 140 as well as an LED array 110. The optical head 100 is driven in the direction of arrow z1 with respect to sensitized sheet 500 by means of head feeding means 300 (mentioned later).

The LED array 110 is composed of two rows of LED elements that emit red (R), green (G), and blue (B) light beams, each row including two LED elements. The LED elements for R, G and B are vertically arranged in the descending order on a photosensitive surface 500*a* of the sensitized sheet 500. Light beams emitted from the LED array 110 pass through the lower half of the cylindrical lens 130 and are reflected by the paraboloidal mirror 120, thus becoming parallel light beams. The parallel light beams reflected by the paraboloidal mirror 120 pass through the upper half of the cylindrical lens 130 and are reflected by the reflector 140. They then advances at right angles to the photosensitive surface 500*a* of the sensitized sheet 500, pass through a liquid crystal shutter 150, and are focused on the photosensitive surface 500*a*. Thus, the focus of each light beam transmitted through the upper half of the cylindrical lens 130 is located on the photosensitive surface 500*a* of the sensitized sheet 500.

The liquid crystal shutter 150 includes one scanning electrode and 640 signal electrodes, whereby 640 pixels are formed in a line in the width direction (direction indicated by arrow z2 in FIG. 1A) of the sensitized sheet 500.

The head feeding means 300 includes an endless optical head scanning wire 373, pulleys 371 and 372 wound with the scanning wire 373, and a DC motor 310 for rotating the pulley 371. A part of the scanning wire 373 is fixed to a wire fixing portion 111 that protrudes from a side face of the optical head 100.

A fin 321 of a rotary encoder 320 is mounted on the rotating shaft of the DC motor 310. A large number of apertures 322 are formed in the fin 321. A light emitting element and a light receiving element (not shown) of a photo-interrupter 323 face each other with the fin 321 between them. The fin 321 and the photo-interrupter 323 constitute the rotary encoder 320.

The fin 321 rotates simultaneously with the DC motor 310. As the fin 321 rotates, the apertures 322 allow intermittent transfer of the light beams between the light emitting and receiving elements of the photo-interrupter 323. An electrical signal is outputted in synchronism with this intermittent transfer of the light beams, whereupon the rotational angular position of the DC motor 310 is detected.

As shown in FIG. 1A, the rotational speed of the DC motor 310 is reduced by means of a worm gear 350 and gears 361, 362 and 363, and is converted into a linear reciprocation by means of the pulleys 371 and 372 and the scanning wire 373. The reciprocation of the scanning wire 373 causes the wire fixing portion 111 to move the optical head 100 in its scanning direction.

A pair of position sensors 210 and 220, formed of a photo-interrupter each, are fixed to a substrate 230 of the optical printer apparatus. When a douser 240 that is fixed to the optical head 100 moves together with the optical head 100 in the scanning direction, any one of or both of the position sensors 210 and 220 are screened from light, whereupon the position of the optical head 100 is detected.

Figure 1B:
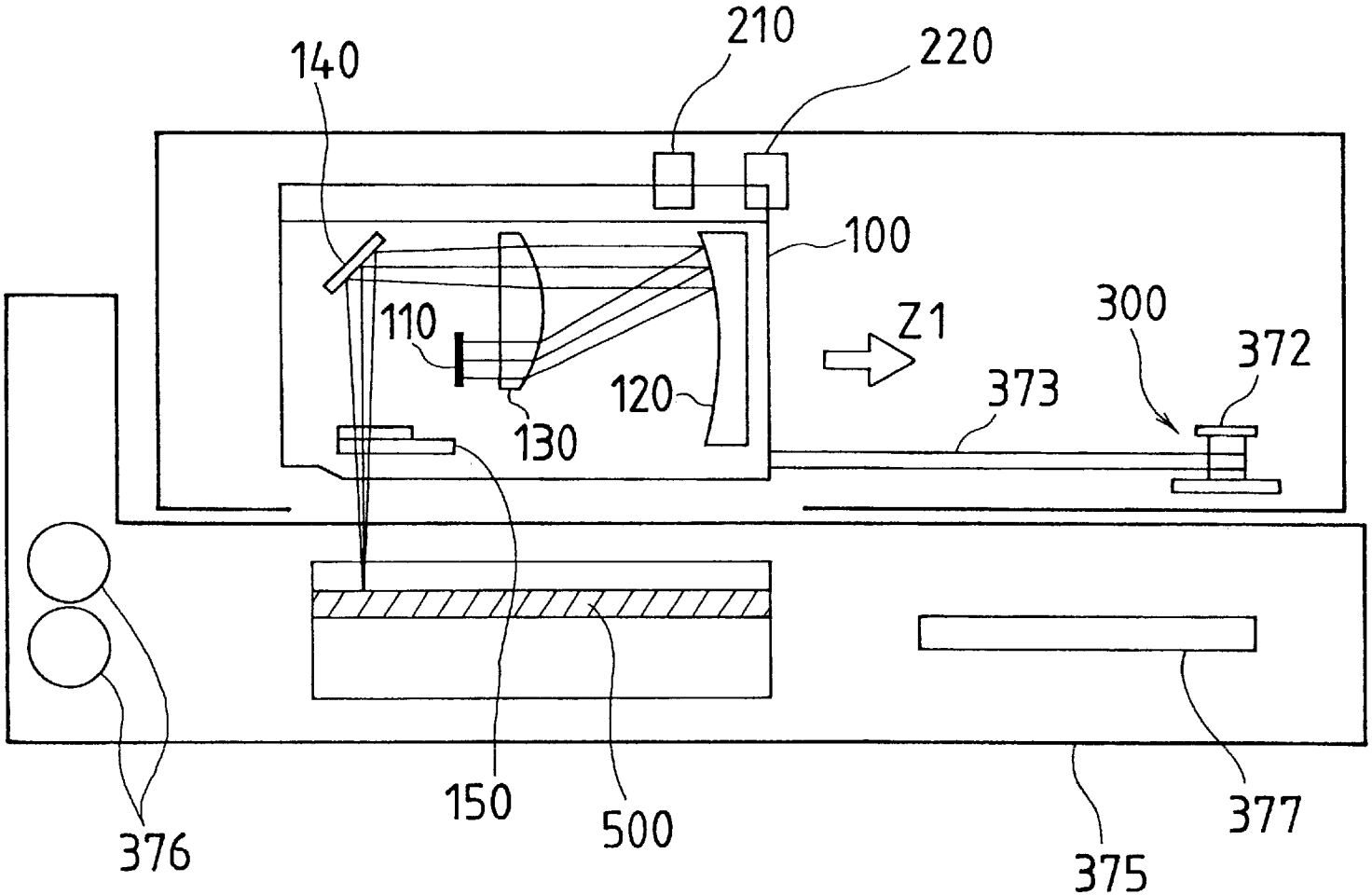
FIG. 1B is a schematic view of the optical printer apparatus of FIG. 1A.

In FIG. 1B, reference numeral 375 denotes a base plate of the optical printer apparatus. The base plate 375 contains therein the sensitized sheet 500, a developing roller 376, a control circuit 377, etc.

The following is a description of a method for forming an image on the sensitized sheet 500.

The LED array 110 emits red, green, and blue light beams in the descending order. The light beams from the LED array 110 spread in the transverse direction (direction indicated by arrow z2 in FIG. 1A) as they pass through the lower half of the cylindrical lens 130 and reach the paraboloidal mirror 120. The light beams reflected by the paraboloidal mirror 120 and spread in the transverse direction are converted into parallel light beams, and pass through the upper half of the cylindrical lens 130. The upper half of the cylindrical lens 130 serves to converge the light beams reflected by the paraboloidal mirror 120 and form an image with a given width on the plane of the sensitized sheet 500.

The light beams converged by the upper half of the cylindrical lens 130 are made to change their courses substantially at 90 degrees by the flat reflector 140, and start to advance at right angles to the plane of the sensitized sheet 500. Then, the light beams pass through the liquid crystal shutter 150, and the sensitized sheet 500 is exposed to them.

The light beams focused with the given width on the sensitized sheet 500 are arranged rearward in the order of R, G and B in the scanning direction (direction z1), as shown in FIG. 1A.

When the optical head 100 is fed at a given speed in the scanning direction (direction of arrow z1) by the head feeding means 300, the douser 111 intercepts both light beams from the photo-interrupters 210 and 220. Thereupon, it is concluded that the optical head 100 is in its write start position, and writing is started.

The following is a description of basic operation for writing.

First, the light beam R passes for a first time that is controlled by means of the liquid crystal shutter 150, whereby a predetermined region of the sensitized sheet 500 is exposed. Then, the light beam G passes for a second time that is controlled by means of the liquid crystal shutter 150, whereby that region is exposed. Further, the light beam B passes for a third time that is controlled by means of the liquid crystal shutter 150, whereby the same region is exposed. Thus, a full-color image is formed on the aforesaid region.

These light beams of the three colors, R, G and B are expected to be applied accurately to a predetermined position on the sensitized sheet 500 in accordance with image data. Accordingly, the emission timing of the LED array 110 and the open-close timing of the liquid crystal shutter 150 are synchronized with the output of the rotary encoder 320 that is mounted on the rotating shaft of DC motor 310.

Figure 2:
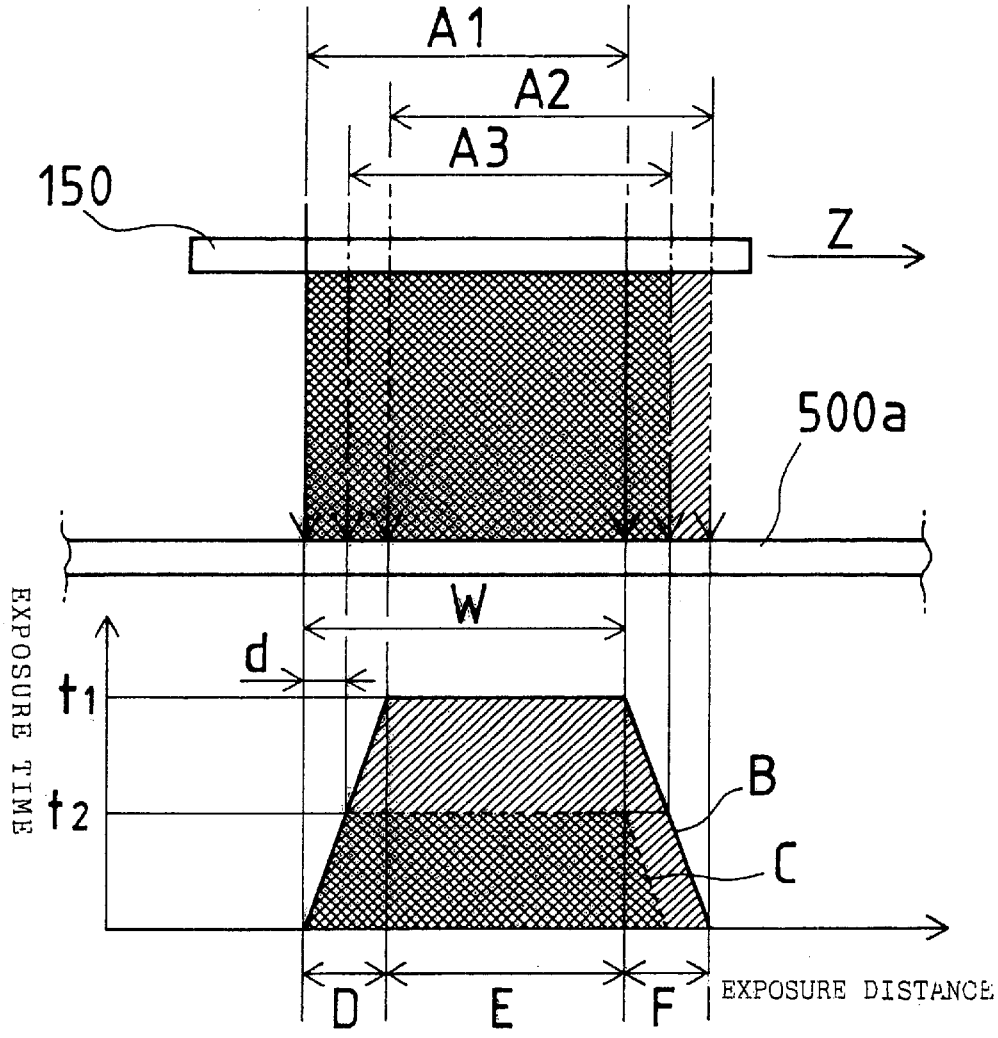
FIG. 2 is a diagram for illustrating the principle of gradation control for the optical printer apparatus according to the present invention.

Referring now to FIG. 2, there will be described gradation control carries out by the optical printer apparatus shown in FIGS. 1A and 1B. FIG. 2 shows the relation of the exposure time to the exposure distance on the photosensitive surface 500*a* of the sensitized sheet 500.

According to FIG. 2, the liquid crystal shutter 150 is closed when the optical head is advanced for the distance D in the z-direction to form an image A2 with a width W on the sensitized sheet surface 500*a* after the light beam R radiated from the liquid crystal shutter 150 forms an image A1 with the width W on the sensitized sheet surface 500*a*.

Thereupon, the relation of the exposure time to the position indicated by the exposure distance on the photosensitive surface 500*a* of the sensitized sheet 500 is represented by a trapezoid B with a height of t1, as shown in FIG. 2. A section E of the photosensitive surface 500*a* corresponding to the top side of the trapezoid B is a region that continues to be exposed for a period of time t1 from the start of exposure to the light beam R to the end of exposure. The exposure time t1 is a value obtained by dividing the distance D of movement by the moving speed (fixed value) of the optical head.

Thus, the exposure time is proportional to the distance D of movement. A maximum exposure time or maximum gradation is obtained when the distance D of movement has its maximum value. In the description to follow, the distance D of movement for this maximum gradation will be referred to as "maximum exposure distance."

In the regions of sections D and F that adjoin the section E, moreover, the exposure time linearly changes from 0 to t1 or from t1 to 0, so that the gradation on the sensitized sheet surface changes according to the exposure distance in the sections E and D.

An intermediate gradation is obtained in the case where the exposure distance is not longer than the maximum exposure distance D. After the light beam R radiated from the liquid crystal shutter 150 forms the image A1 with the width W on the sensitized sheet surface 500*a*, the optical head is advanced for a distance d (<D). When an image A3 with the width W is formed on the sensitized sheet surface 500*a*, the liquid crystal shutter 150 is closed. Thereupon, the relation of the exposure time to the position indicated by the exposure distance on the photosensitive surface 500*a* of the sensitized sheet 500 is represented by a trapezoid C with a height of t2 (<t1), as shown in FIG. 2. Then, a gradation corresponding to the exposure time t2 is given.

In the optical printer apparatus shown in FIGS. 1A and 1B, as described above, the exposure time t2 or gradation can be changed by changing the exposure distance d.

The following is a description of several examples of exposure timing for the exposure of the sensitized sheet 500 by means of the optical printer apparatus.

Figure 3:
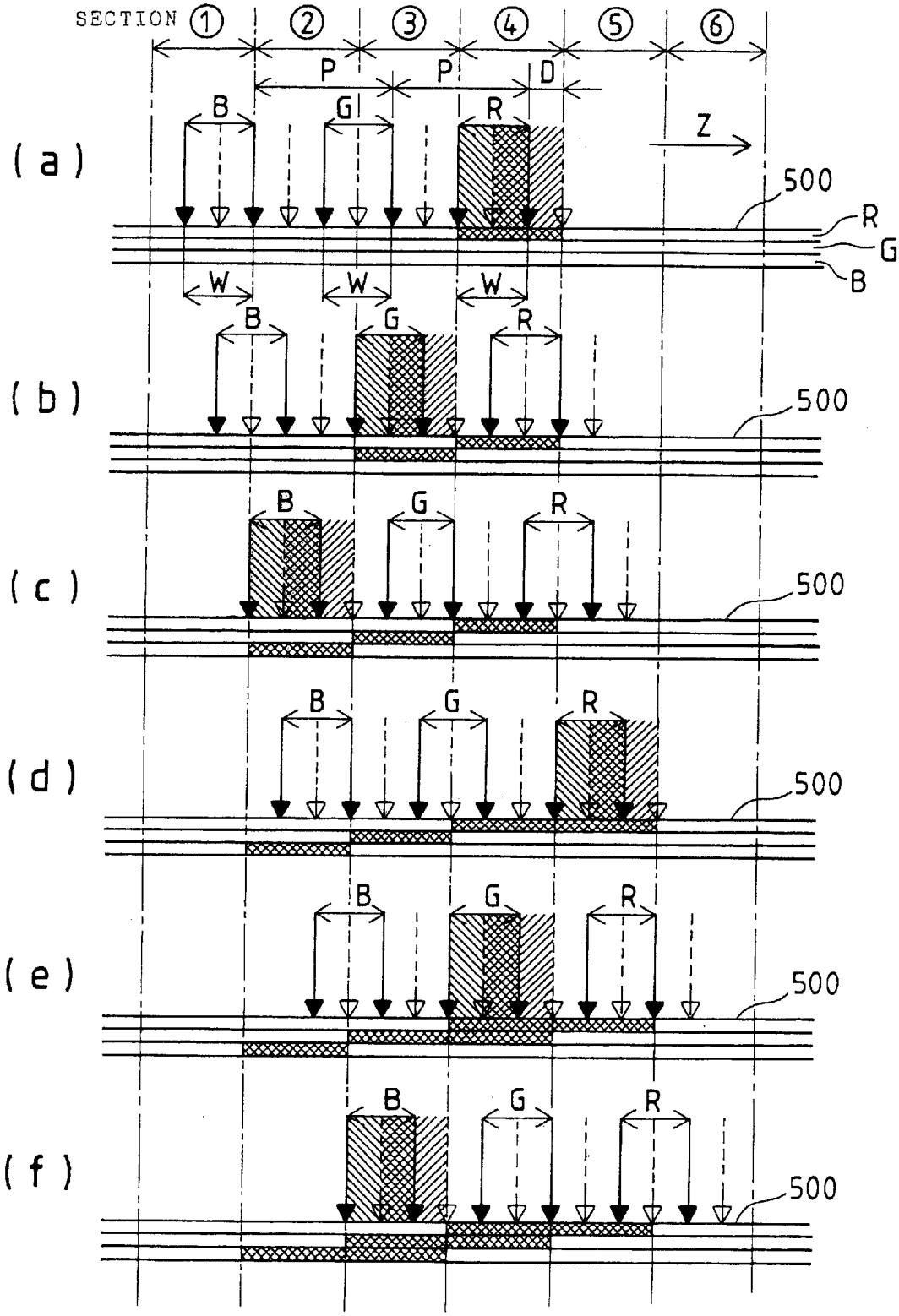
FIG. 3 is a diagram for illustrating exposure timing for an 10 optical printer apparatus according to a first embodiment of the present invention to expose a sensitized sheet, showing first and second exposure cycles.
Figure 4:
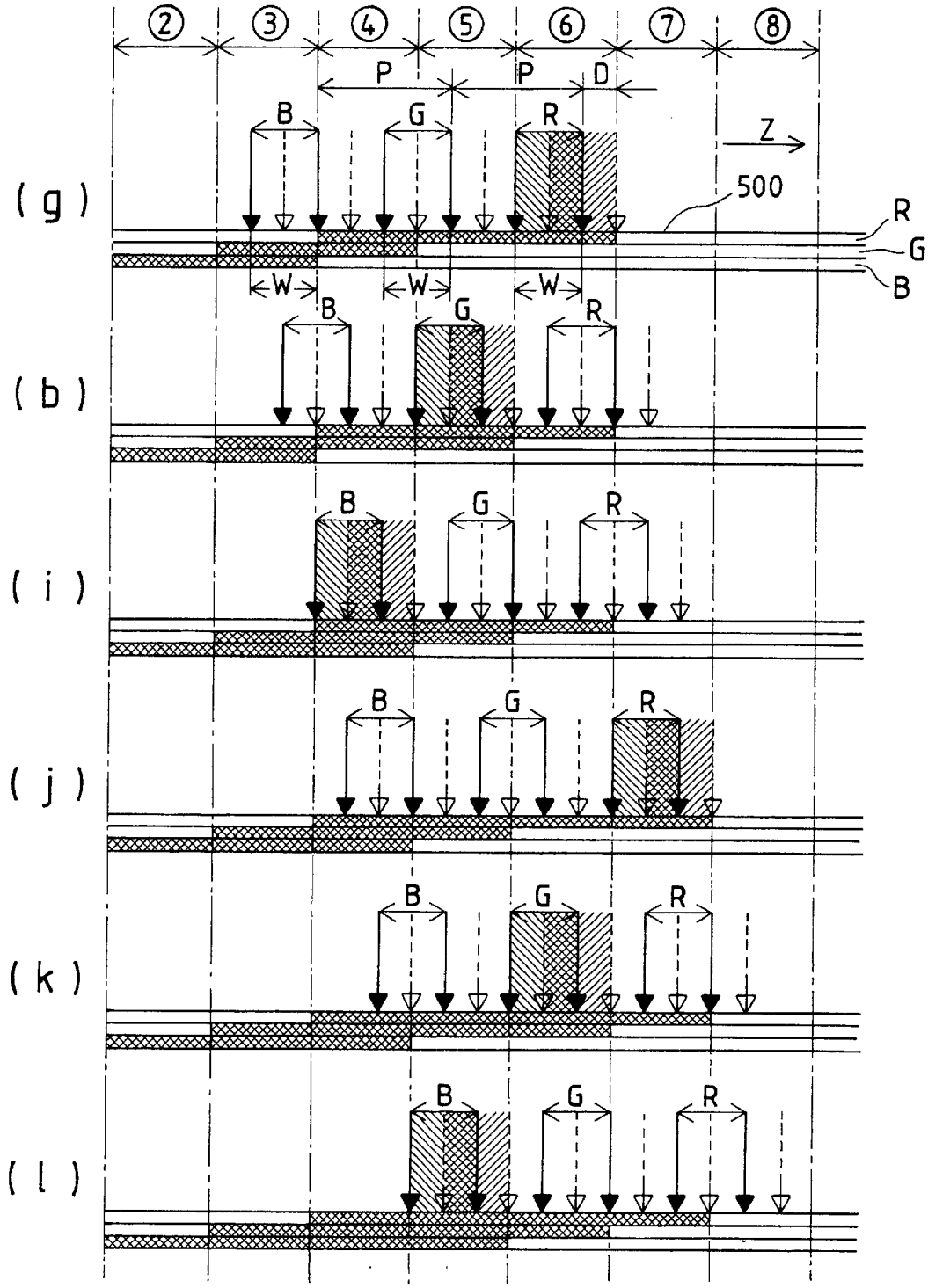
FIG. 4 is the continuation of FIG. 3, showing third and fourth exposure cycles.

First Embodiment: FIGS. 3 and 4

A first embodiment will be described with reference to FIGS. 3 and 4. In FIGS. 3 and 4, the optical head moves at uniform speed in the direction of arrow Z with respect to the sensitized sheet 500. Then, the light beams R, G and B radiated from the optical head are indicated by two full-line arrows that are directed toward the sensitized sheet 500. Dotted-line arrows indicate the respective positions of the light beams after movement for the maximum exposure distance.

The hatching between the two full-line arrows for R, G or B indicate that the light beam R, G or B is in a radiation start position. On the other hand, the hatching between the two dotted-line arrows for R, G or B indicates that the light beam R, G or B is in a radiation end position where it moved by the maximum exposure distance from the radiation start position. Thus, the region in which the hatching between the two full-line arrows for R, G or B and the hatching between the two dotted-line arrows are superposed corresponds to the region E shown in FIG. 2, in which the exposure time is t1 and the maximum gradation is given.

Figure 17:
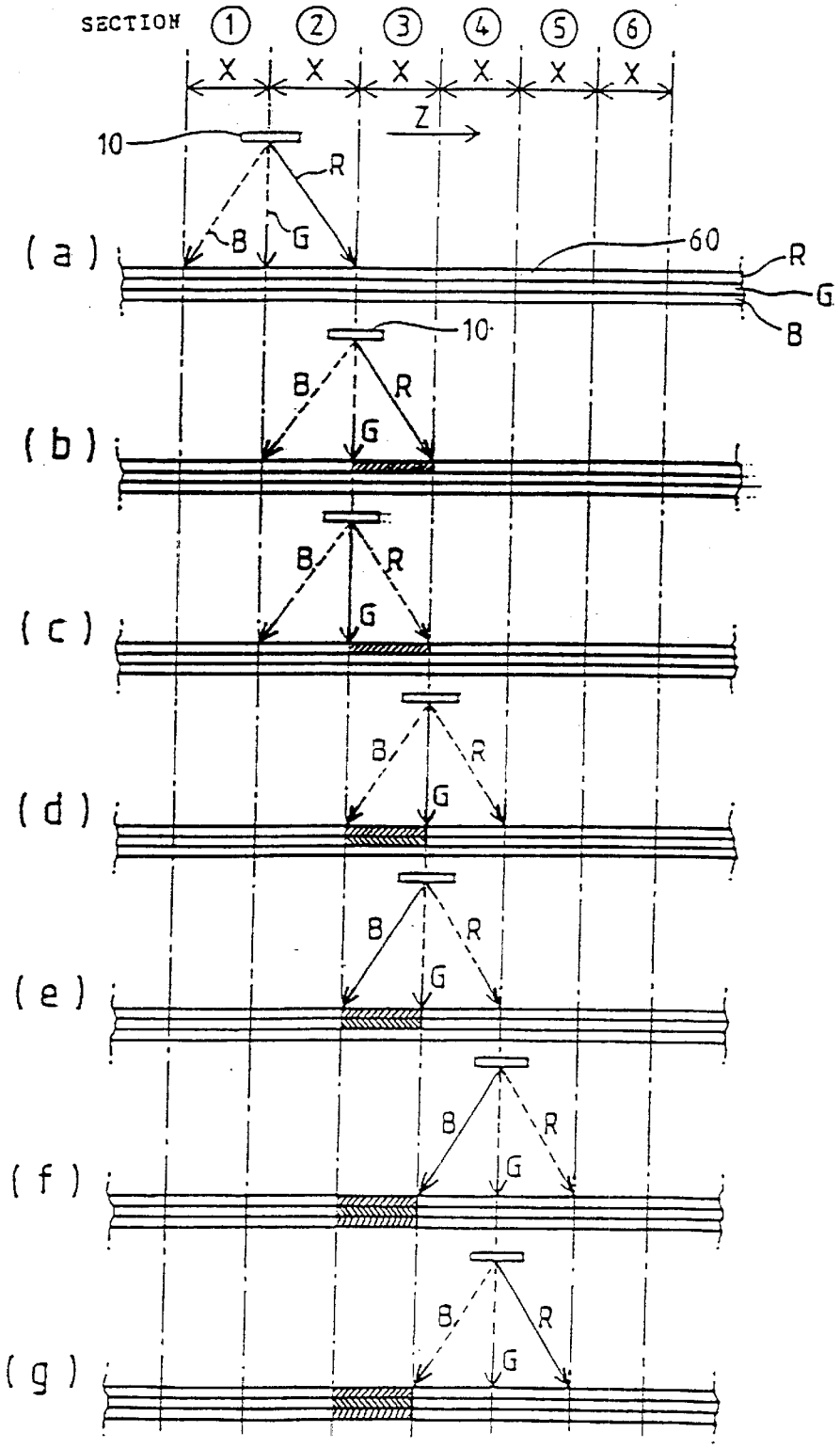
Fig. 17 Prior Art
FIG. 17 is a diagram for illustrating exposure timing for the conventional optical printer apparatus to expose a sensitized sheet.

In order to indicate the color, R, G or B, of the light beam to which the sensitized sheet 500 is exposed, moreover, the sensitized sheet 500 is divided into three layers for convenience, as described in connection with the prior art example shown in FIG. 17. Exposure to the light beam R is represented by the hatching on the first layer from the top, exposure to the light beam G by the hatching on the second layer, and exposure to the light beam B by the hatching on the third layer from the top.

Sections ① to ⑧ individually represent pixels in the scanning direction of the optical head.

As shown in (a) of FIG. 3, the light beams R, G and B individually form images with the width W on the sensitized sheet 500. These images are arranged at equal spaces in the scanning direction (direction Z shown in (a) of FIG. 3) of the optical head. The layout pitch (image pitch) for the images is indicated by P in (a) of FIG. 3. The image width W is twice as long as the maximum exposure distance D.

The size of the image pitch P is settled by P=(NC+1)D. In this expression, C is the number of color light beams. In the case of the present embodiment, C=3, as three colors R, G and B are used. D is the maximum exposure distance. N is a positive integer (N=1, 2 . . . ). In the present embodiment, N=1 is selected, so that P=4D is obtained.

(First Exposure Cycle: (a) to (c) of FIG. 3)

(a) Exposure of Section ④ to Light Beam R: The light beam R starts to be radiated in the position indicated by full-line arrows, and the section ④ is then exposed thereto as the light beam R moves to the position indicated by dotted-line arrows, that is, for the maximum exposure distance D, whereupon the radiation terminates. As this is done, the light beams G and B are not radiated. With this radiation of the light beam R, only a sensitizing agent that is applied to the sensitized sheet 500 and reacts to the light beam R is exposed. This exposure is represented by hatching the first layer from the top of the section ④ of the sensitized sheet 500.

(b) Exposure of Section ③ to Light Beam G: The moment the radiation of the light beam R is finished, the light beam G starts to be radiated in the position indicated by full-line arrows, and the section ③ is then exposed thereto as the light beam G moves to the position indicated by dotted-line arrows, that is, for the maximum exposure distance D, whereupon the radiation terminates. This exposure is represented by hatching the second layer from the top of the section ③ of the sensitized sheet 500.

(c) Exposure of Section ② to Light Beam B: The moment the radiation of the light beam G is finished, the light beam B starts to be radiated in the position indicated by full-line arrows, and the section ② is then exposed thereto as the light beam B moves to the position indicated by dotted-line arrows, that is, for the maximum exposure distance D, whereupon the radiation terminates. This exposure is represented by hatching the third layer from the top of the section ② of the sensitized sheet 500.

Thus, each cycle of emission of R, G and B shown in (a) to (c) of FIG. 3 constitutes one exposure cycle. This exposure cycle is repeated many times to expose the sensitized sheet 500, whereupon an image is formed on the surface of the sensitized sheet.

In the one exposure cycle, as described above, each light beam continues to be emitted (that is, the maximum exposure time is given, and the maximum gradation is given to each section) while it moves for the maximum exposure distance D. Actually, however, the gradation of each light beam is controlled, so that the maximum exposure time is not always given. In the case where the gradation is controlled, as mentioned before, the radiation distance (radiation time) is adjusted by closing the liquid crystal shutter 150 halfway with the light not radiated throughout the maximum exposure distance D. Thus, the exposure distance (exposure time) is adjusted.

As described above, different sections on the sensitized sheet 500 are exposed to the light beams, individually, in each exposure cycle. More specifically, the sections ④, ③ and ③ are exposed to the light beams R, G and B, respectively, in a first exposure cycle. Thus, the image data are designed to control the radiation distance in the section ③, the radiation distance in the (adjacent) section ③, and the radiation distance in the (adjacent) section ②, individually.

(Second Exposure Cycle: (d) to (f) of FIG. 3)

(d) Exposure of Section ⑤ to Light Beam R: The moment the radiation of the light beam B (see (c) of FIG. 3) is finished, the light beam R starts to be radiated in the position indicated by full-line arrows, and the section ⑤ is then exposed thereto as the light beam R moves to the position indicated by dotted-line arrows, that is, for the maximum exposure distance D, whereupon the radiation terminates.

(e) Exposure of Section ④ to Light Beam G: The moment the radiation of the light beam R is finished, the light beam G starts to be radiated in the position indicated by full-line arrows, and the section ④ is then exposed thereto as the light beam G moves to the position indicated by dotted-line arrows, that is, for the maximum exposure distance D, whereupon the radiation terminates.

(f) Exposure of Section ③ to Light Beam B: The moment the radiation of the light beam G is finished, the light beam B starts to be radiated in the position indicated by full-line arrows, and the section ③ is then exposed thereto as the light beam B moves to the position indicated by dotted-line arrows, that is, for the maximum exposure distance D, whereupon the radiation terminates.

(Third Exposure Cycle: (g) to (i) of FIG. 4)

(g) Exposure of Section ⑥ to Light Beam R: Explanation is omitted here and in the following.

(h) Exposure of Section ⑤ to Light Beam G:

(i) Exposure of Section ④ to Light Beam B: When the exposure of section ④ to the light beam B is finished, the section ④ can be concluded to have been exposed to all the light beams R, G and B.

(Fourth Exposure Cycle: (j) to (l) of FIG. 4)

(j) Exposure of Section ⑦ to Light Beam R:

(k) Exposure of Section ⑥ to Light Beam G:

(l) Exposure of Section ⑤ to Light Beam B: When the exposure of section ⑤ to the light beam B is finished, the section ⑤ can be concluded to have been exposed to all the light beams R, G and B.

In a fifth exposure cycle (not shown), moreover, the section ⑥ is exposed to all the light beams R, G and B. In this manner, the sections exposed to all the light beams R, G and B increase one by one in the scanning direction (direction Z) of the optical head with every exposure cycle. Thus, the whole surface of the sensitized sheet is exposed to the light beams of the three primary colors having gradations, whereby a full-color image is formed.

Figure 5:
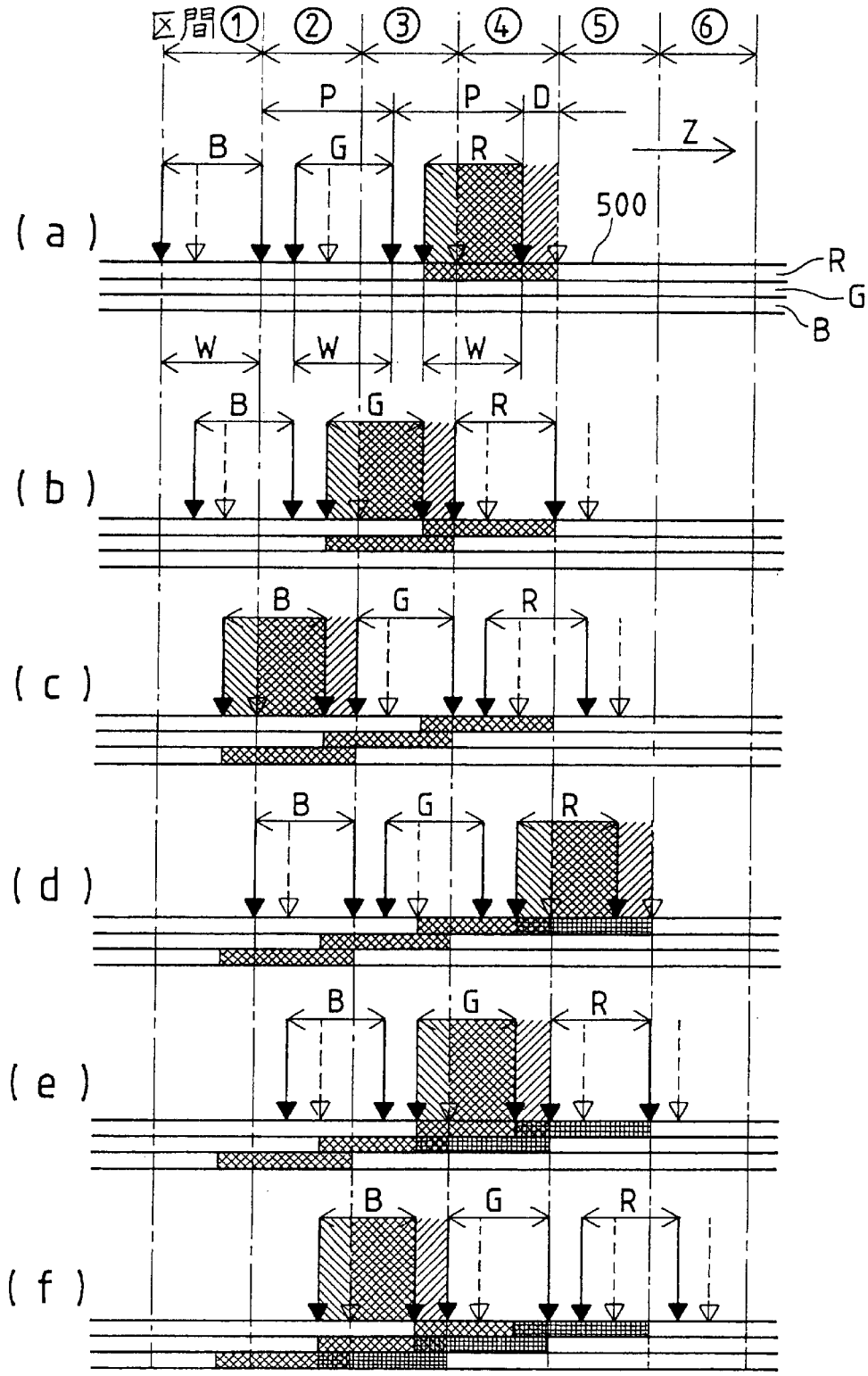
FIG. 5 is a diagram for illustrating exposure timing for an optical printer apparatus according to a second embodiment of the present invention to expose a sensitized sheet, showing first and second exposure cycles.
Figure 6:
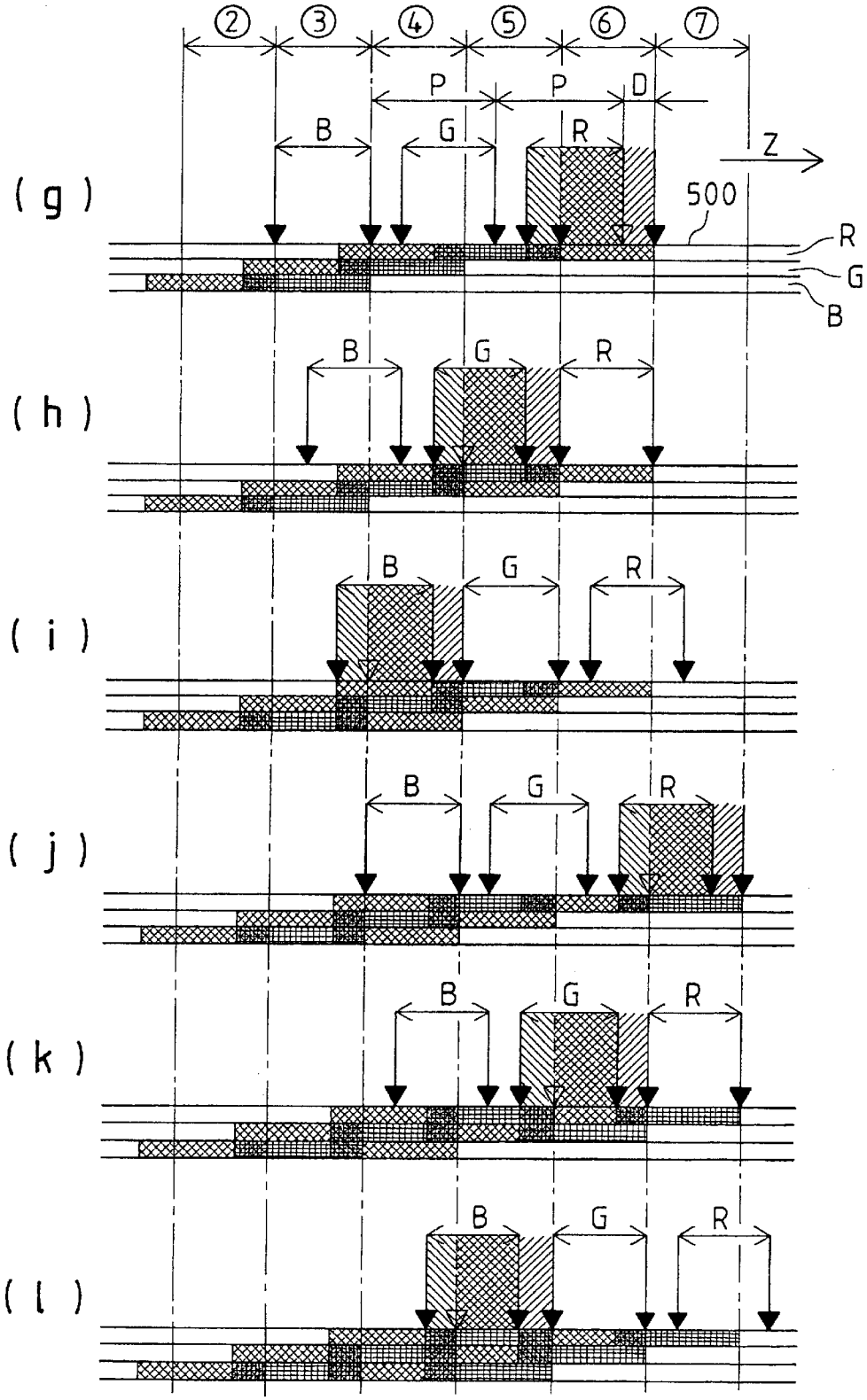
FIG. 6 is the continuation of FIG. 5, showing third and fourth exposure cycles.

Second Embodiment: FIGS. 5 and 6

A second embodiment will be described with reference to FIGS. 5 and 6. This embodiment differs from the first embodiment shown in FIGS. 3 and 4 only in that the width W of the image of the color light beams R, G and B on the sensitized sheet 500 is three times (twice in the first embodiment) as long as the maximum exposure distance D. The image pitch P and the maximum exposure distance D has the same relation, P=4D, as in the first embodiment.

Since the image width W according to the second embodiment is greater than that according to the first embodiment, however, the exposure sections overlap one another for a margin corresponding to the maximum exposure distance D in the manner described below. (The exposure sections never overlap one another in the first embodiment.)

(First Exposure Cycle: (a) to (c) of FIG. 5)

(a) Exposure of Section ④ to Light Beam R: The image width W is so great that ⅓ of the adjacent section ③, as well as the section ④, is exposed to the light beam R.

(b) Exposure of Section ③ to Light Beam G: Likewise, ⅓ of the adjacent section ②, as well as the section ③, is exposed to the light beam G. A third of the section ③ that is nearer to the section ④ is exposed to both the light beams G and R.

The width of the region that is doubly exposed to those two light beams can be adjusted by changing the image width W By changing the correspondence between the image data and the actual image, moreover, the section ③ and ⅓ of its adjacent section ④ (on the side remoter from ② can be made to be exposed to the light beam G. A high-quality image with improved color mixture between pixels can be formed by superposing the exposure sections in this manner.

(c) Exposure of Section ② to Light Beam B: Likewise, ⅓ of the adjacent section ①, as well as the section ②, is exposed to the light beam B. A third of the section ② that is nearer to the section ③ is exposed to the two light beams B and G.

(Second Exposure Cycle: (d) to (f) of FIG. 5)

(d) Exposure of Section ⑤ to Light Beam R: Explanation is omitted here and in the following.

(e) Exposure of Section ④ to Light Beam G:

(f) Exposure of Section ③ to Light Beam B:

(Third Exposure Cycle: (g) to (i) of FIG. 6)

(g) Exposure of Section ⑥ to Light Beam R:

(h) Exposure of Section ⑤ to Light Beam G:

(i) Exposure of Section ④ to Light Beam B: When this exposure is finished, the section ④ can be concluded to have been exposed to all the light beams R, G and B.

(Fourth Exposure Cycle: (j) to (l) of FIG. 6)

(j) Exposure of Section ⑦ to Light Beam R:

(k) Exposure of Section ⑥ to Light Beam G:

(l) Exposure of Section ⑤ to Light Beam B: When this exposure is finished, the section ⑤ can be concluded to have been exposed to all the light beams R, G and B.

By further repeating the exposure cycles described above, the section ⑥ and the subsequent sections are successively exposed to the light beams R, G and B. Thus, a full-color image can be obtained without involving unexposed regions between pixels on the sensitized sheet.

Figure 7:
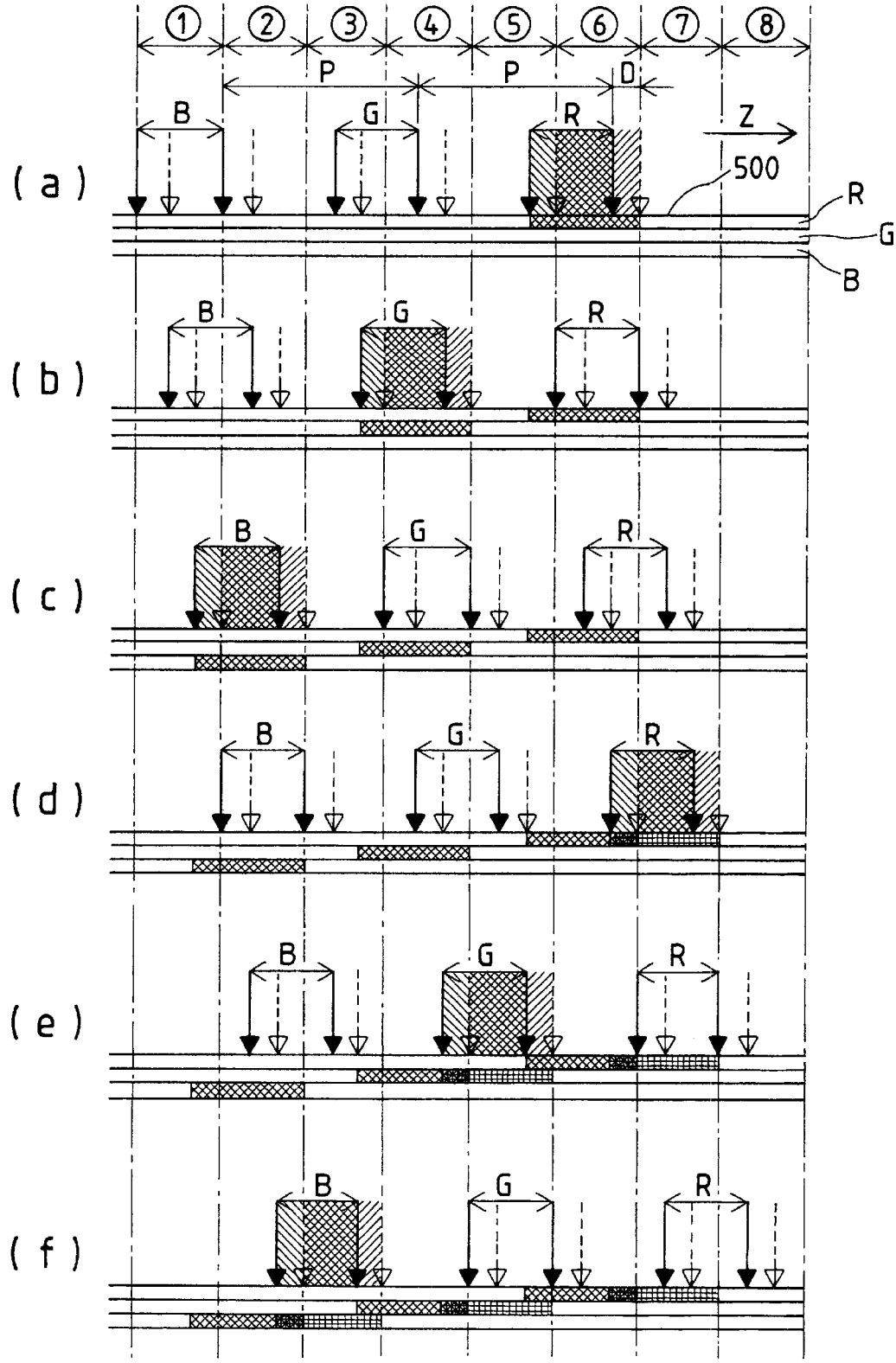
FIG. 7 is a diagram for illustrating exposure timing for an optical printer apparatus according to a third embodiment of the present invention to expose a sensitized sheet, showing first and second exposure cycles.
Figure 8:
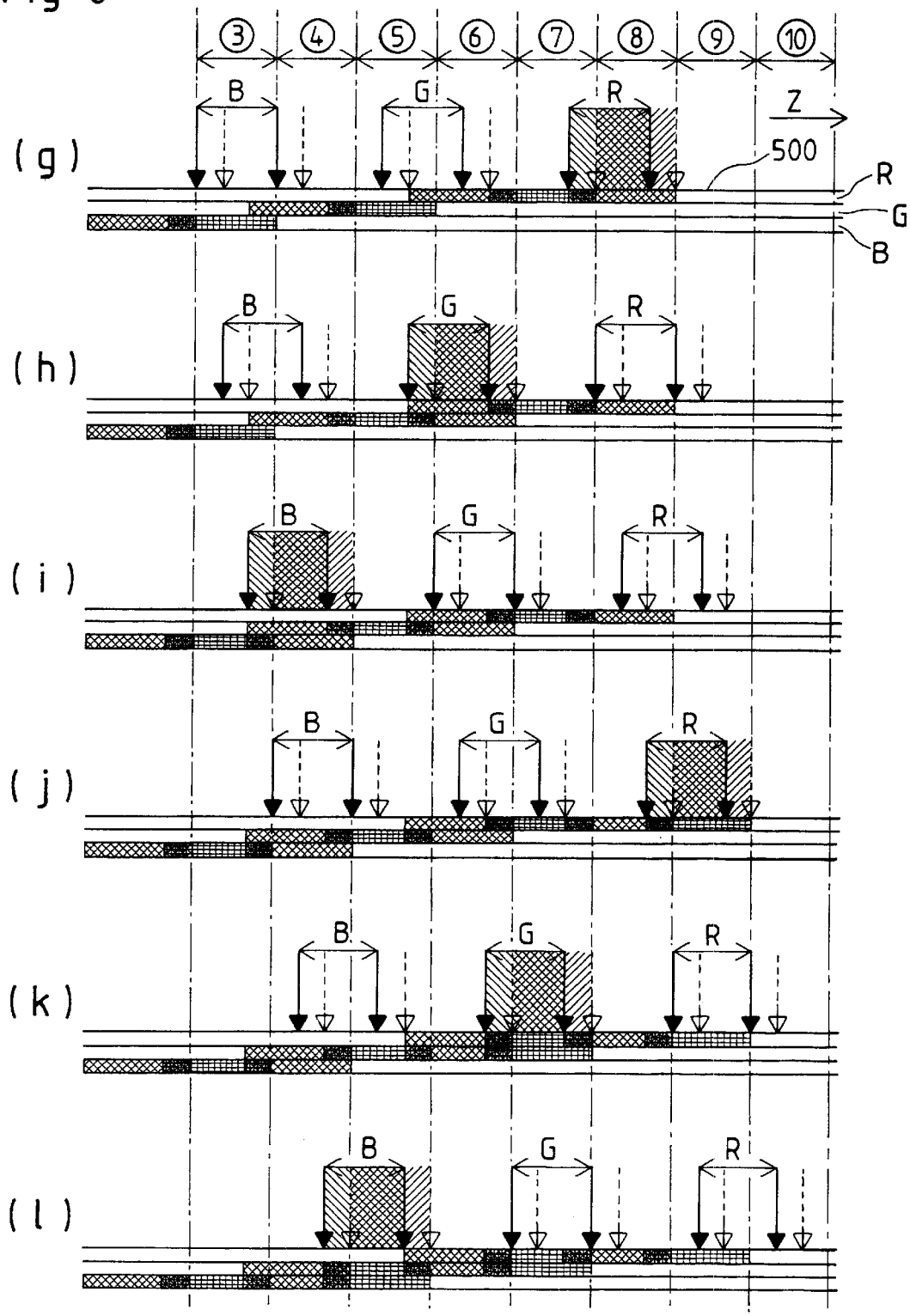
FIG. 8 is the continuation of FIG. 7, showing third and fourth exposure cycles.
Figure 9:
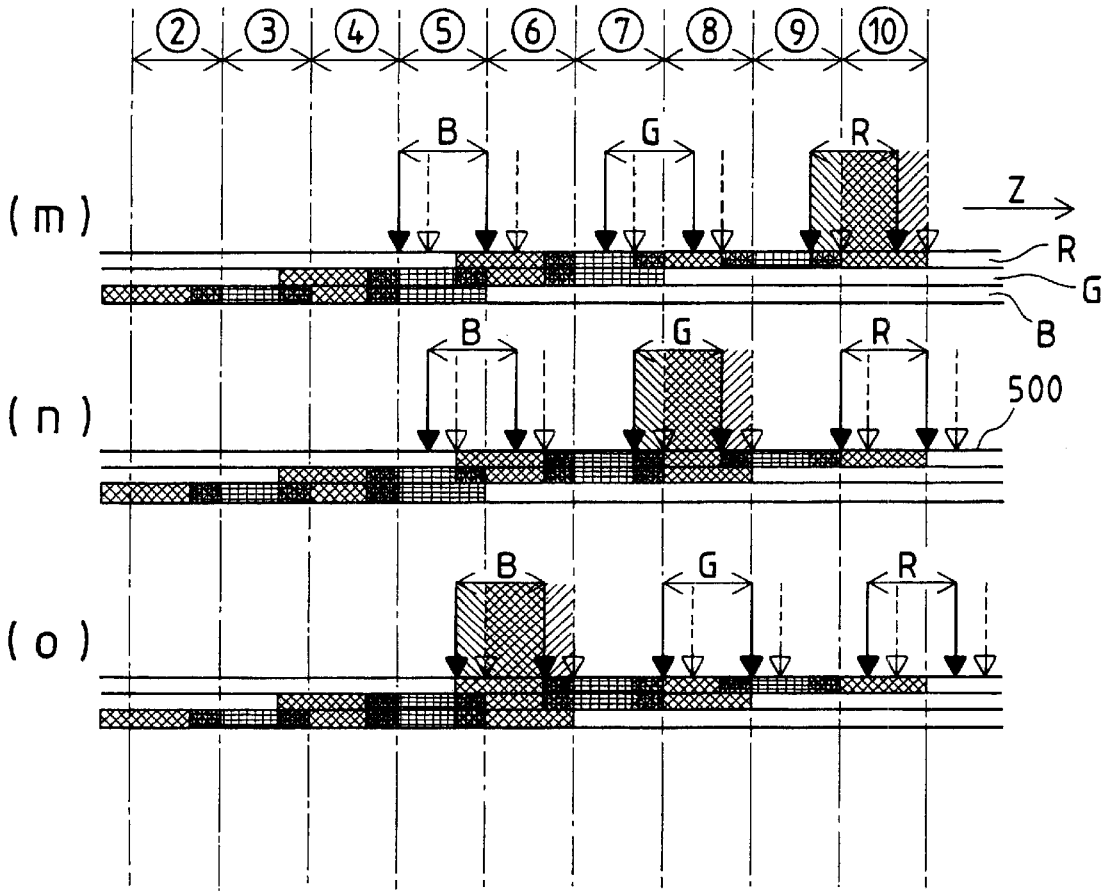
FIG. 9 is the continuation of FIG. 8, showing a fifth exposure cycle.

Third Embodiment: FIGS. 7, 8 and 9

A third embodiment will be described with reference to FIGS. 7, 8 and 9. The third embodiment differs from the foregoing second embodiment (C=3, N=1; P=4D) in that the aforementioned expression P=(NC+1)D is rewritten as P=7D based on C=3 and N=2.

(First Exposure Cycle: (a) to (c) of FIG. 7)

(a) Exposure of Section ⑥ to Light Beam R: Explanation is omitted here and in the following.

(b) Exposure of Section ④ to Light Beam G:

(c) Exposure of Section ② to Light Beam B:

(Second Exposure Cycle: (d) to (f) of FIG. 7)

(d) Exposure of Section ⑦ to Light Beam R:

(e) Exposure of Section ⑤ to Light Beam G:

(f) Exposure of Section ③ to Light Beam B:

(Third Exposure Cycle: (g) to (i) of FIG. 8)

(g) Exposure of Section ⑧ to Light Beam R:

(h) Exposure of Section ⑥ to Light Beam G:

(i) Exposure of Section ④ to Light Beam B:

(Fourth Exposure Cycle: (j) to (l) of FIG. 8)

(j) Exposure of Section ⑨ to Light Beam R:

(k) Exposure of Section ⑦ to Light Beam G:

(l) Exposure of Section ⑤ to Light Beam B:

(Fifth Exposure Cycle: (m) to (o) of FIG. 9)

(m) Exposure of Section ⑩ to Light Beam R:

(n) Exposure of Section ⑧ to Light Beam G:

(o) Exposure of Section ⑥ to Light Beam B: When this exposure is finished, the section ⑥ can be concluded to have been exposed to all the light beams R, G and B.

By further repeating the exposure cycles described above, the section ⑦ and the subsequent sections are successively exposed to the light beams R, G and B. Thus, a full-color image can be obtained without involving unexposed regions between pixels on the sensitized sheet.

Figure 10:
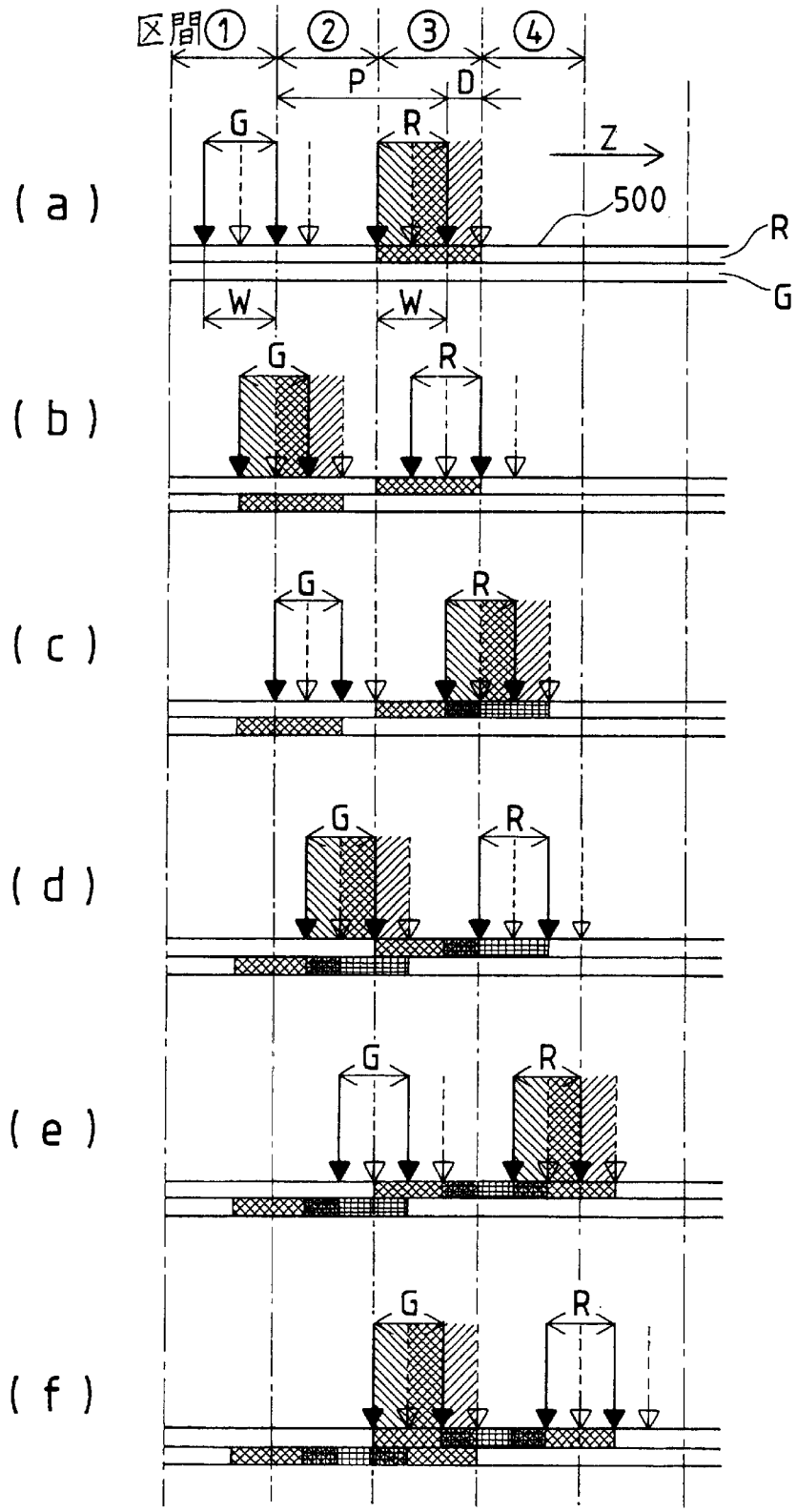
FIG. 10 is a diagram for illustrating exposure timing for an optical printer apparatus according to a fourth embodiment of the present invention to expose a sensitized sheet.

Fourth Embodiment: FIG. 10

A fourth embodiment will be described with reference to FIG. 10. In the fourth embodiment, the number of colors is not 3 but two (R and G). Accordingly, the aforementioned expression P=(NC+1)D is rewritten as P=5D based on C=2 and N=2.

(a) Exposure of Section ③ to Light Beam R: Explanation is omitted here and in the following.

Figure 11:
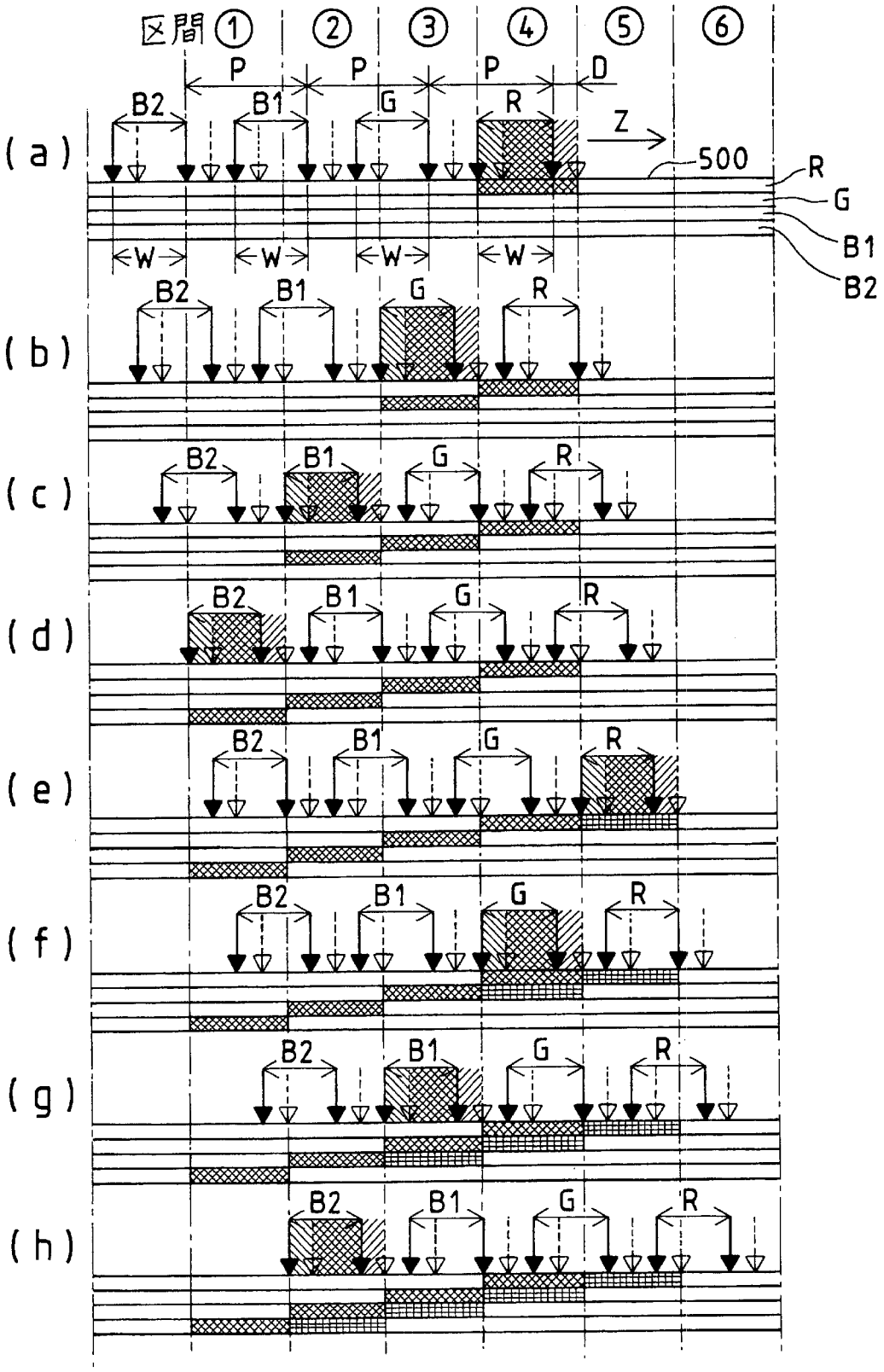
FIG. 11 is a diagram for illustrating exposure timing for an optical printer apparatus according to a fifth embodiment of the present invention to expose a sensitized sheet, showing first and second exposure cycles.
Figure 12:
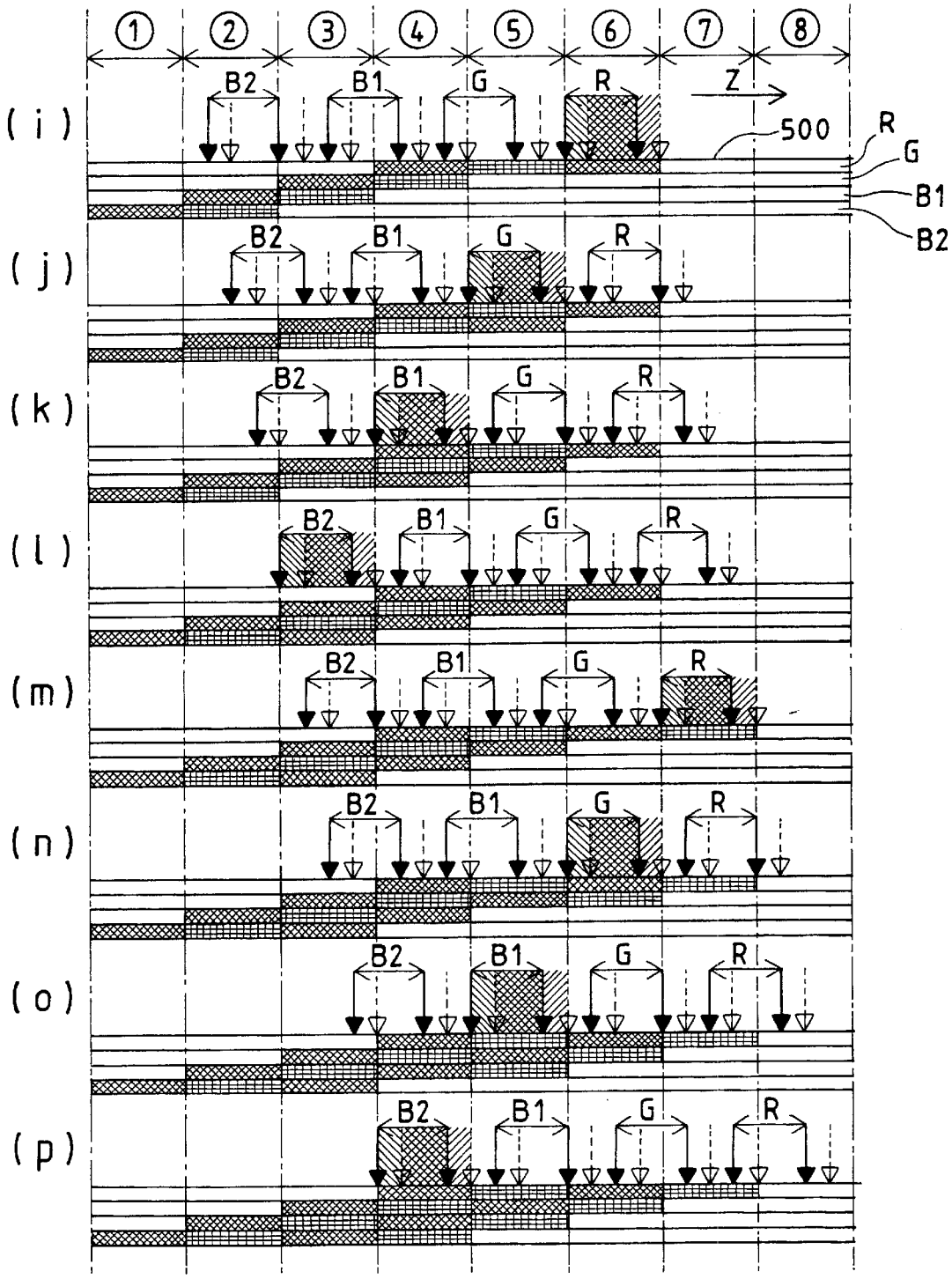
FIG. 12 is the continuation of FIG. 11, showing third and fourth exposure cycles.

(b) Exposure of Section ② to Light Beam G:

(c) Exposure of Section ④ to Light Beam R:

(d) Exposure of Section ② to Light Beam G:

(e) Exposure of Section ④ to Light Beam R:

(f) Exposure of Section ③ to Light Beam G:

Fifth Embodiment: FIGS. 11 and 12

A fifth embodiment will be described with reference to FIGS. 11 and 12. In the fifth embodiment, the number of colors is not 3 (R, G and B) but four (R, G, B1 and B2). In this case, B is divided into B1 and B2 so that a predetermined exposure intensity for B on the sensitized sheet can be obtained by exposing the sheet twice with the light beams B1 and B2, since the light beam B is feeble due to the characteristics of the LED. Accordingly, the image pitch, which is given by the aforementioned expression P=(NC+1)D, is rewritten as P=5D based o[008e] C=4 and N=1.

(First Exposure Cycle: (a) to (d) of FIG. 11)

(d) Exposure of Section ④ to Light Beam R: Explanation is omitted here and in the following.

(e) Exposure of Section ③ to Light Beam G:

(f) Exposure of Section ② to Light Beam B1:

(g) Exposure of Section ① to Light Beam B2:

(Second Exposure Cycle: (e) to (h) of FIG. 11)

(e) Exposure of Section ⑤ to Light Beam R:

(f) Exposure of Section ④ to Light Beam G:

(g) Exposure of Section ③ to Light Beam B1:

(h) Exposure of Section ② to Light Beam B2:

(Third Exposure Cycle: (i) to (l) of FIG. 12)

(i) Exposure of Section ⑥ to Light Beam R:

(j) Exposure of Section ⑤ to Light Beam G:

(k) Exposure of Section ④ to Light Beam B1:

(l) Exposure of Section ③ to Light Beam B2:

(Fourth Exposure Cycle: (m) to (p) of FIG. 12)

(m) Exposure of Section ⑦ to Light Beam R:

(n) Exposure of Section ⑥ to Light Beam G:

(o) Exposure of Section ⑤ to Light Beam B1:

(p) Exposure of Section ④ to Light Beam B2: When this exposure is finished, the section ④ is exposed to the four color light beams R, G, B1 and B2.

By further repeating the exposure cycles described above, the section ⑤ and the subsequent sections are successively exposed to the four color light beams. Thus, a full-color image can be obtained without involving unexposed regions between pixels on the sensitized sheet.

Figure 13:
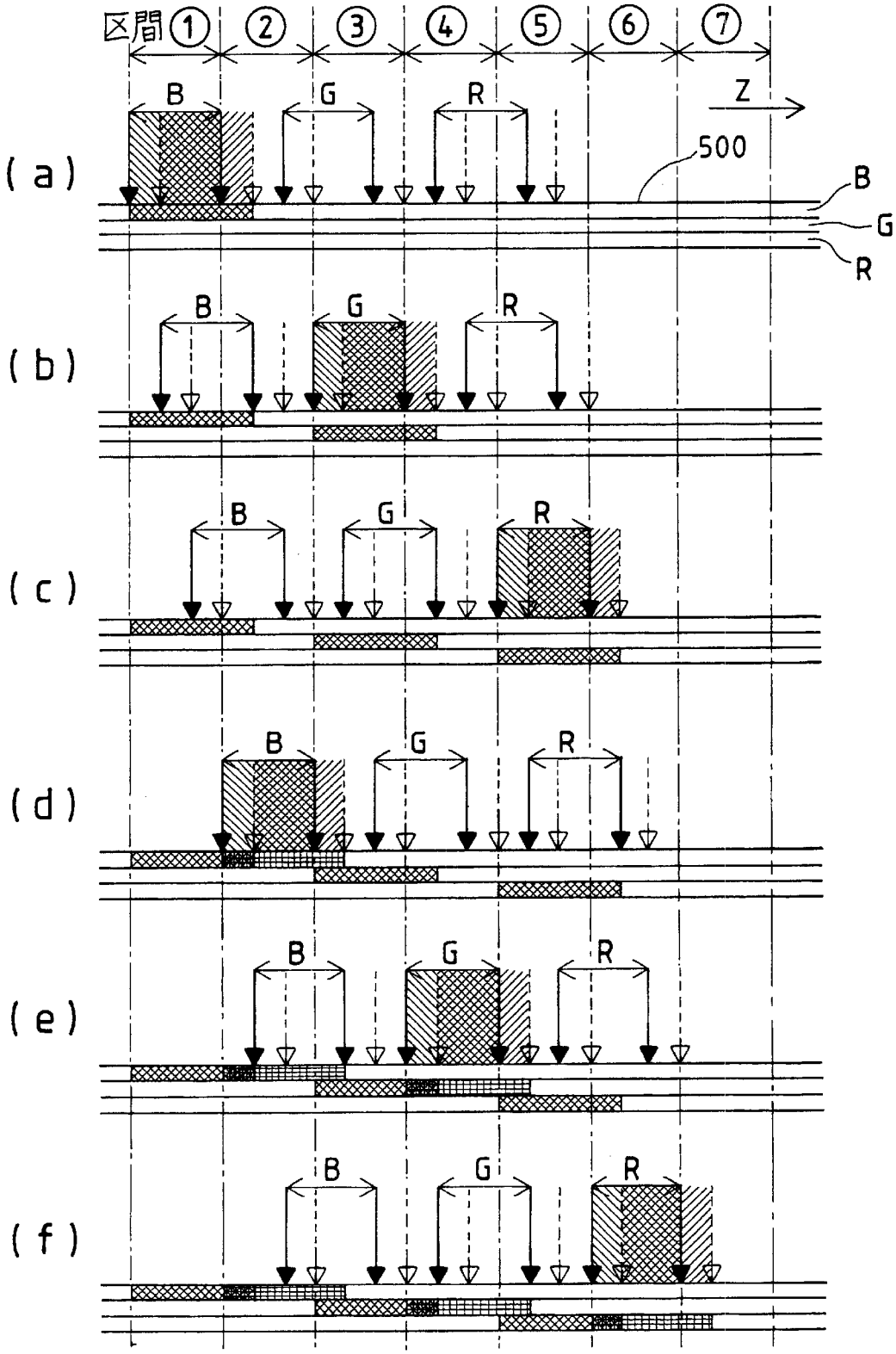
FIG. 13 is a diagram for illustrating exposure timing for an optical printer apparatus according to a sixth embodiment of the present invention to expose a sensitized sheet, showing first and second exposure cycles.
Figure 14:
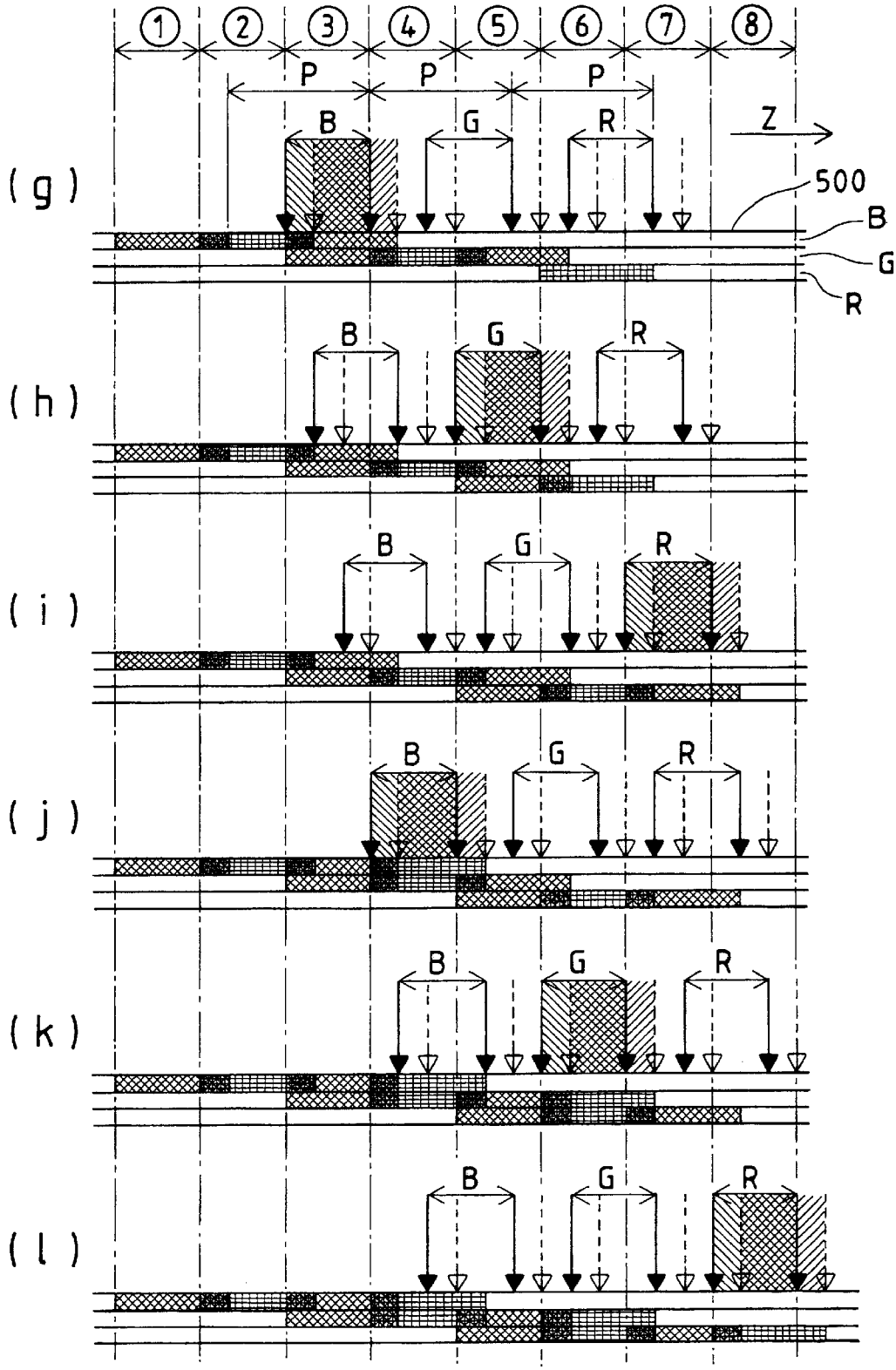
FIG. 14 is the continuation of FIG. 13, showing third and fourth exposure cycles.
Figure 15:
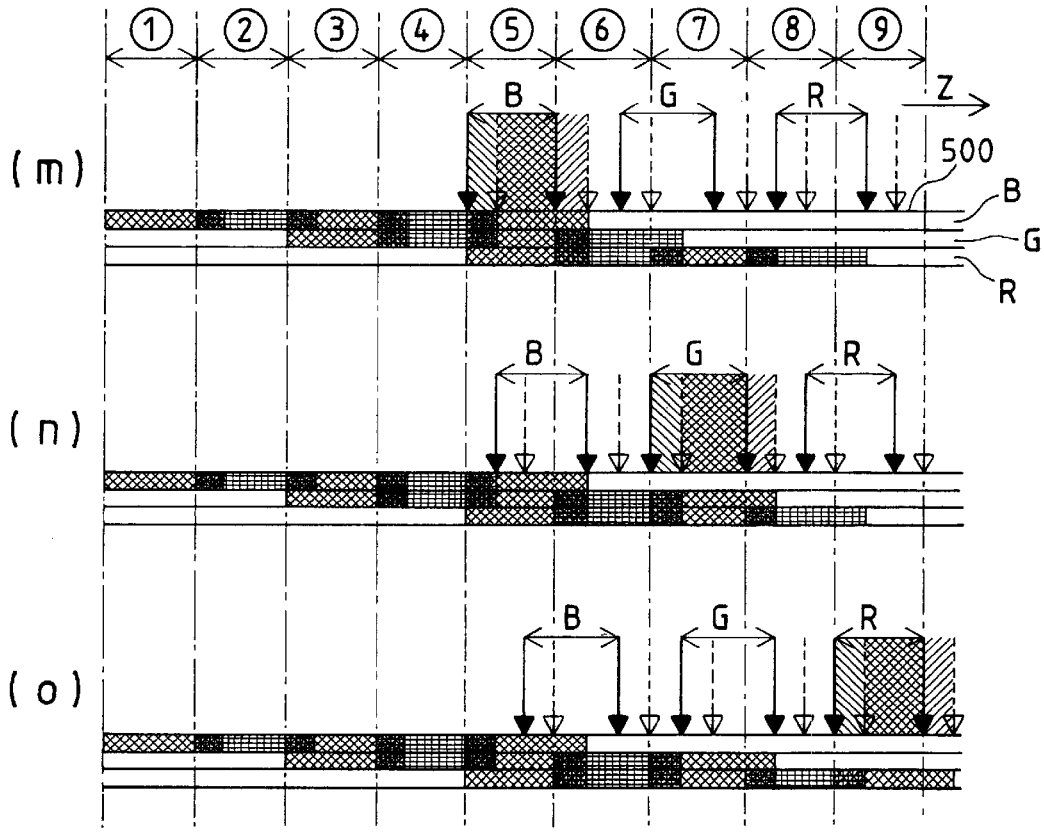
FIG. 15 is the continuation of FIG. 13, showing a fifth exposure cycle.
Figure 16:
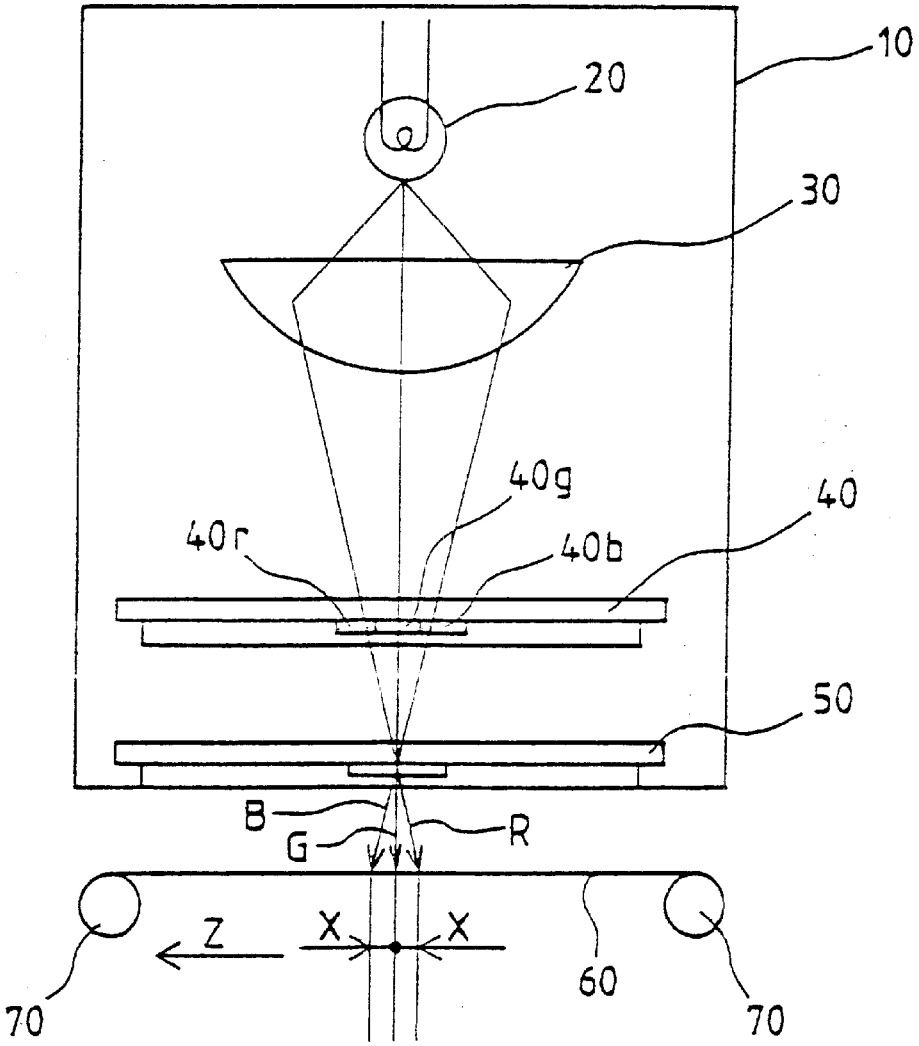
Fig. 16 Prior Art
FIG. 16 is a schematic sectional view of a conventional optical printer apparatus.

Sixth Embodiment: FIGS. 13, 14 and 15

A sixth embodiment will be described with reference to FIGS. 13, 14 and 15. The sixth embodiment differs from the foregoing embodiments in that the light beams from the LED are emitted in the direction opposite to the moving direction Z of the optical head. The three color light beams R, G and B are arranged in the moving direction Z of the optical head in the order named.

In this case, the relation between the image pitch P and the maximum exposure distance D is given by P=(NC−1)D, which is rewritten as P=5D based on N=2 and C=3 (R, G and B).

(First Exposure Cycle: (a) to (c) of FIG. 13)

(a) Exposure of Section ① to Light Beam B: Explanation is omitted here and in the following.

(b) Exposure of Section ③ to Light Beam G:

(c) Exposure of Section ⑤ to Light Beam R:

(Second Exposure Cycle: (d) to (f) of FIG. 13)

(d) Exposure of Section ② to Light Beam B:

(e) Exposure of Section ④ to Light Beam G:

(f) Exposure of Section ⑥ to Light Beam R:

(Third Exposure Cycle: (g) to (i) of FIG. 14)

(g) Exposure of Section ③ to Light Beam B:

(h) Exposure of Section ⑤ to Light Beam G:

(i) Exposure of Section ⑦ to Light Beam R:

(Fourth Exposure Cycle: (j) to (l) of FIG. 14)

(j) Exposure of Section ④ to Light Beam B:

(k) Exposure of Section ⑥ to Light Beam G:

(l) Exposure of Section ⑧ to Light Beam R:

(Fifth Exposure Cycle: (m) to (o) of FIG. 15)

(m) Exposure of Section ⑤ to Light Beam B: When this exposure is finished, the section ⑤ is exposed to the light beams R, G and B.

(n) Exposure of Section ⑦ to Light Beam G:

(o) Exposure of Section ⑨ to Light Beam B:

By further repeating the exposure cycles described above, the section ⑥ and the subsequent sections are successively exposed to the light beams R, G and B. Thus, a full-color image can be obtained without involving unexposed regions between pixels on the sensitized sheet.

What is claimed is:

1. An optical printer apparatus which comprises an optical head capable of radiating a plurality of color light beams while moving relatively to a sensitized material, and a drive unit for driving at least one of the optical head and the sensitized material in order to cause the optical head and the sensitized material to move relatively to each other at constant speed, wherein the optical printer apparatus is designed so that individual images formed on the sensitized material when said plurality of color light beams are radiated simultaneously are arranged at given pitches in the direction of said relative movement when the optical head is stationary with respect to the sensitized material, and wherein an image is formed on the sensitized material as the light beams are applied in a predetermined order during said relative movement of the optical head, characterized in that a maximum exposure distance D is smaller than an image pitch P, where the image pitch P is the image pitch of said plurality of color light beams on the sensitized material and the maximum exposure distance D is the relative movement distance of said optical head with respect to said sensitized material, which corresponds to the maximum exposure time of said color light beams.

2. An optical printer apparatus according to claim 1, wherein said image pitch P is substantially equal to an integer multiple of said maximum exposure distance D.

3. An optical printer apparatus according to claim 2, wherein said plurality of color light beams are applied in a predetermined order in the direction of the movement of said optical head relative to said sensitized material.

4. An optical printer apparatus according to claim 3, wherein the relation between the image pitch P and the maximum exposure distance D is given by P=(NC+1)D, where C is the number of color light beams and N is a positive integer not smaller than 1.

5. An optical printer apparatus according to claim 4, wherein said number C of color light beams is 3.

6. An optical printer apparatus according to claim 5, wherein said color light beams of three different colors include a red light beam, a green light beam, and a blue light beam.

7. An optical printer apparatus according to claim 6, wherein said positive integer N is 1, and the relation between the image pitch P and the maximum exposure distance D is given by P=4D.

8. An optical printer apparatus according to claim 4, wherein said number C of color light beams is 4.

9. An optical printer apparatus according to claim 8, wherein said color light beams of three different colors include a red light beam, a green light beam, and a blue light beam.

10. An optical printer apparatus according to claim 2, wherein said plurality of color light beams are applied in an order in the direction opposite to the direction of the movement of said optical head relative to said sensitized material.

11. An optical printer apparatus according to claim 10, wherein the relation between the image pitch P and the maximum exposure distance D is given by P=(NC−1)D, where C is the number of color light beams and N is a positive integer not smaller than 1.

12. An optical printer apparatus according to claim 11, wherein said number C of color light beams is 3.

13. An optical printer apparatus according to claim 12, wherein said color light beams of three different colors include a red light beam, a green light beam, and a blue light beam.

14. An optical printer apparatus according to claim 13, wherein said arbitrary position integer N is 1, and the relation between the image pitch P and the maximum exposure distance D is given by P=4D.

15. An optical printer apparatus according to claim 14, wherein said number C of color light beams is 4.

16. An optical printer apparatus according to claim 5, wherein said color light beams of four different colors include a red light beam, a green light beam, and two blue light beams.

17. An optical printer apparatus according to any one of claims 1 to 16, wherein a light source for radiating said color light beams is formed of an LED (light emitting diode).

18. An optical printer apparatus according to any one of claims 4 to 16, wherein said optical head carries out gradation control by controlling the exposure time of each pixel in accordance with gradated image data composed of a plurality of pixels, thereby forming a gradated image on said sensitized material.

19. An optical printer apparatus according to claim 18, wherein, when any one of said plurality of color light beams undergoes gradation control in accordance with M-th pixel data, as counted in the direction opposite to the moving direction of said optical head with respect to said sensitized material, where M is a positive integer not smaller than 1, and in the case where the color light beam is adjoined by another color light beam in the moving direction of said optical head, said another color light beam undergoes gradation control in accordance with (M+N)-th pixel data based on said positive integer N, as counted in the direction opposite to the moving direction of said optical head, and in the case where the color light beam is adjoined by another color light beam in the direction opposite to the moving direction of said optical head, said another color light beam undergoes gradation control in accordance with (M−N)-th pixel data based on said positive integer N, as counted in the direction opposite to the moving direction of said optical head.

20. A color printing method in which the surface of a sensitized sheet is divided into a plurality of regions (1, 2, 3 . . . N . . . ) in the scanning direction of an optical head and gradations for first, second, and third colors are assigned for each region by image data, comprising steps of:

(a) opening a shutter of the optical head, radiating a light beam of a first color with a given width toward an N-th region on the sensitized sheet, then moving the optical head to move the light beam in the scanning direction of the optical head, and closing the shutter in a position reached by the light beam advanced from a radiation start position by a distance d11 (≦D) assigned by the image data;

(b) opening said shutter again after moving the optical head by a distance which allows the light beam of the first color to move for a preset distance D, radiating a light beam of a second color with the width W toward an (N−1)-th region on the sensitized sheet, then moving the optical head to move the light beam in the scanning direction of the optical head, and closing the shutter in a position reached by the light beam advanced from the radiation start position by a distance d12 (≦D) assigned by the image data;

(c) opening said shutter again after moving the optical head by a distance which allows the light beam of the second color to move by the preset distance D, radiating a light beam of a third color with the width W toward an (N−2)-th region on the sensitized sheet, then moving the optical head to move the light beam in the scanning direction of the optical head, and closing the shutter in a position reached by the light beam advanced from the radiation start position by a distance d13 (≦D) assigned by the image data;

(d) opening said shutter again after moving the optical head by a distance which allows the third color light to move by the preset distance D, radiating the light beam of the third color with the width W toward an (N+1)-th region on the sensitized sheet, then moving the optical head to move the light beam in the scanning direction of the optical head, and closing the shutter in a position reached by the light beam advanced from the radiation start position by a distance d21 (≦D) assigned by the image data; and (e) executing the same operation thereafter.

21. An optical printer apparatus comprising:

an optical head radiating a plurality of color light beams while moving relatively to a sensitized material, and a drive unit for driving at least one of the optical head and the sensitized material in order to cause the optical head and the sensitized material to move relatively to each other at constant speed, wherein said color light beams are radiated one by one on a time-sharing basis without simultaneous radiation among them, and in a predetermined order periodically in association with the relative movement of said optical head with respect to said sensitized material, and an image width W of said color light beams on the sensitized material in the direction of said relative movement is smaller than a maximum exposure distance D which is the relative movement distance of said optical head with respect to said sensitized material, and which corresponds to a maximum exposure time of said color light beams.

22. The optical printer apparatus according to claim 20, wherein said color light beams are of red (R), green (G), and blue (B) colors.

* * * * *